US006846372B1

(12) United States Patent
Guirguis

(10) Patent No.: US 6,846,372 B1
(45) Date of Patent: Jan. 25, 2005

(54) REACTIVELY INDUCED FRAGMENTATING EXPLOSIVES

(75) Inventor: Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/401,890

(22) Filed: Mar. 31, 2003

(51) Int. Cl.[7] ..... C06B 45/00
(52) U.S. Cl. ..... 149/2; 149/19.1; 102/473
(58) Field of Search ..... 149/2, 19.1; 102/473

(56) References Cited

U.S. PATENT DOCUMENTS 3,389,025 A * 6/1968 Nix et al. ..... 149/19.1
3,830,671 A * 8/1974 McArdle ..... 149/2
4,351,240 A 9/1982 McCubbin et al. ..... 102/364
4,612,859 A 9/1986 Furch et al. ..... 102/476
4,872,409 A * 10/1989 Becker et al. ..... 102/517
5,299,501 A 4/1994 Anderson ..... 102/364
5,509,357 A 4/1996 Lawther ..... 102/307
5,544,589 A 8/1996 Held ..... 102/492
5,547,526 A * 8/1996 Wanninger et al. ..... 149/19.2
6,393,991 B1 5/2002 Funston et al. ..... 102/476

* cited by examiner

*Primary Examiner*—Aileen Felton
(74) *Attorney, Agent, or Firm*—Mark Homer

(57) ABSTRACT

The invention, as embodied herein, comprises a new composition that provides different outputs depending upon the level of stimulus supplied to the composition. More specifically, if the composition is subjected to a weak shock, the composition produces fragments that burn upon their surfaces. If the composition is subjected to a strong shock, the bulk of the fragments will initiate, and, depending upon the make-up of the fragments, an explosive, propellant, or pyrotechnic, a different output will result.

10 Claims, 6 Drawing Sheets

REACTIVELY INDUCED FRAGMENTATING EXPLOSIVES

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates in general to explosive formulations, more particularly to composite solid explosive formulations, and even more particularly to composite solid explosive formulations that fragment instead of detonating when subjected to a weak shock, but fully detonate when subjected to a strong shock. The present invention also relates to several applications of said explosive formulations. These incude composite solid explosives with an adjustable yield, thermobaric explosives, and explosives specifically tailored to chemically damage electronic equipment.

2. Description of the Related Art

In general, composite explosives are currently formulated by combining several components, all in powder form, but with at least one component capable of binding the others. In the case of pressed explosives, for example, a small fraction of wax or viton is added to the other energetic components and the mixture pressed. In the case of melt cast explosives, such as Composition B, made of RDX and TNT, the mixture is heated until the TNT melts, stirred, then slowly cooled until the TNT solidifies. In the case of plastic bonded explosives, the components of a polymer minus the curative are mixed with the energetic crystals then the curative added for cross-linking. The common feature among all of these explosive formulations is that the energetic materials are small particles, usually 100 microns or smaller, uniformly distributed throughout the explosive charge.

In a traditional fragmentation warhead, a metal shell usually surrounds the explosive core. When the explosive detonates, the high pressures generated fracture the metal and launch the resulting fragments at high velocity. However, in some warheads, pre-fragmented metal shrapnel are interspersed within the explosive itself. In some warheads the shell is not inert. U.S. Pat. No. 4,351,240 discloses a warhead comprising fragments arranged around the periphery of the warhead that are made of an incendiary metal material that ignites when heated sufficiently. U.S. Pat. No. 5,299,501 discloses a projectile composed of brittle material wherein the casing disintegrates upon impact and incendiary particles are propelled through a hole created in the warhead. But the explosive itself is made of small particles uniformly distributed throughout.

This uniformity of the explosive structure imposes limitations on its performance. For example, the explosive can be designed to accomplish a specific task, but only that task well. The particular chemical composition of the explosive is chosen from several candidates to perform the task best. If none of the candidates can alone perform the task well, several chemical compositions are uniformly mixed together in the same explosive. For example, an explosive charge mostly composed of HMX (Cyclotetramethylenetetranitramine) is good for fragmenting metal cases and driving the fragments at high velocity, but it will perform less than optimum in internal blast applications. That is because to drive fragments well, the explosive has to release a large amount of gases fast, but a good internal blast explosive has to be rich in fuels that react with the air contained inside the target, an intrinsically slow process. HMX and Al (Aluminum) particles can be uniformly mixed to create a good internal blast explosive, however, that would not be optimal for fragmenting metal and driving the fragments at high velocity.

Moreover, the traditional deign of a fragmenting warhead whereby the metal shell surrounds the explosive imposes limitations. The fragments are uniformly dispersed in all directions, thus only a small portion reaches the target. Attempts were made to improve the fragments pattern by still using one explosive material, but varying the shape of the explosive material or liners associated with the warhead along with a plurality of detonation points around and within the explosive material. For example, U.S. Pat. No. 6,393,991 discloses a multipurpose shaped warhead having a plurality of detonation points along the periphery of the explosive material and one detonation point in the center of the explosive material. U.S. Pat. No. 5,509,357 discloses a dual operating mode warhead having one explosive material with two different liners associated with two detonation points wherein detonating one of the points provides a certain output as a result of the liner associated with said point. U.S. Pat. No. 4,612,859 discloses a multiple purpose warhead having three different shaped explosives within a warhead, each having a different detonation point. Finally, U.S. Pat. No. 5,544,589 discloses a fragmentation warhead having multiple detonation points wherein selecting certain detonation points directs the fragments in a certain direction.

However, no explosive is currently formulated by consolidating macroscopic fragments, each fragment being itself a complete explosive formulation, instead of the traditional method of consolidating microscopic particles in which case by definition the particles are uniformly distributed throughout the resulting explosive. And no warhead design is currently capable of adjusting on demand the velocity of the fragments as well as optimally achieve substantially different outputs, such as high velocity fragments and a strong internal blast, simultaneously.

SUMMARY OF THE INVENTION

The invention proposed herein comprises a new class of composite, solid explosives or energetic formulations. Instead of the traditional method of consolidating microscopic particles of energetic materials, metal fuels, and binder, in which case, by definition, the particles are uniformly distributed throughout the resulting energetic material, these new composite solid materials are formulated by consolidating macroscopic fragments, each fragment being itself a complete shock-insensitive energetic formulation, comprising a number of microscopic particles of energetic materials, metal fuels, and binder. When the formulation is an explosive, unlike traditional explosives that simply fail to detonate when subjected to a weak shock, the remainder of the composite matrix surrounding and binding these macroscopic energetic fragments together is made of a relatively shock-sensitive energetic material that ignites when subjected to a weak shock, so that its resulting hot gas products reliably separate the fragments, disperse them, and also start their surface burning. On the other hand, the bulk of each macroscopic fragment is also ignited, thus initiating a full-fledged detonation in the explosive charge. Because the macroscopic fragments integrated within the composite explosive are independent from the remainder of the matrix holding the fragments together, the different components can be selected to be shock and/or heat sensitive as the user desires, such that numerous new warhead applications can be designed by incorporating these formulations.

Accordingly, it is the object of this invention to provide a formulation that provides multiple outputs depending upon the level of stimulus or strength of shock used for initiation.

It is a further object of this invention to provide a formulation that when subjected to a weak shock it reliably disperses the comprised fragments of an explosive material and starts their surface burning.

This invention meets these and other objectives by providing a composition made up of a plurality of shock insensitive, energetic macroscopic fragments mixed into a base material. The base material holding the fragments together may be just an inert binder or a full-fledged composite explosive formulation, depending upon the desired use of the composition. When subjected to a weak shock, the fragments ignite on their surface only. When subjected to a strong shock, the bulk of each fragment is also ignited, thus a full-fledged detonation initiated in the explosive charge. The fragments, rather than being microscopic particles each comprising just one energetic material, a metal fuel, or an oxidizer are macroscopic in size, normally about 2 mm or larger. Each fragment is a complete composite energetic formulation, a composite propellant, explosive, or a pyrotechnic mixture, that may include energetic crystals, such as RDX or HMX, a solid fuel, such as aluminum particles, an oxidizer, and a binder.

Finally, the invention also includes use of the formulation described above in various warhead configurations to provide numerous outputs including thermobaric warheads, variable output warheads, electronic equipment damaging warheads, reactive fragment warheads, and directional fragmentation warheads.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF PREFERRED EMBODIMENTS

The invention, as embodied herein, comprises a new composition that provides different outputs depending upon the level of stimulus supplied to the composition. More specifically, if the composition is subjected to a weak shock, the composition produces fragments that burn upon their surfaces. If the composition is subjected to a strong shock, the bulk of the fragments will initiate, and, depending upon the make-up of the fragments, an explosive, propellant, or pyrotechnic, a different output will result.

As used within this application, these terms are defined to mean the following. Shock sensitive means that the material will initiate if subjected to about 5 kbars of shock or greater. Shock insensitive means that the material will not initiate if subjected to about 25 kbars of shock or less. Heat sensitive means that the material will ignite and burn vigorously at normal, sea-level atmospheric pressures (1 atm.) when subjected to temperatures of about 600 degrees centigrade or smaller temperatures. Heat insensitive means that a material will not ignite and burn vigorously at normal atmospheric pressures unless subjected to temperatures of about 1200 degrees centigrade or greater. A weak shock means a shock of 10 kbars or less and a strong shock means a shock of about 30 kbars or greater.

In general, the invention comprises a plurality of shock insensitive, energetic macroscopic fragments that are held together by a base material. When subjected to a weak shock, the fragments will not initiate, but the surface of the fragments will burn vigorously. When subjected to a strong shock, the fragments will initiate. Therefore, multiple outputs can be obtained from one material, depending upon the level of stimulus supplied to the material.

Figure 1A:
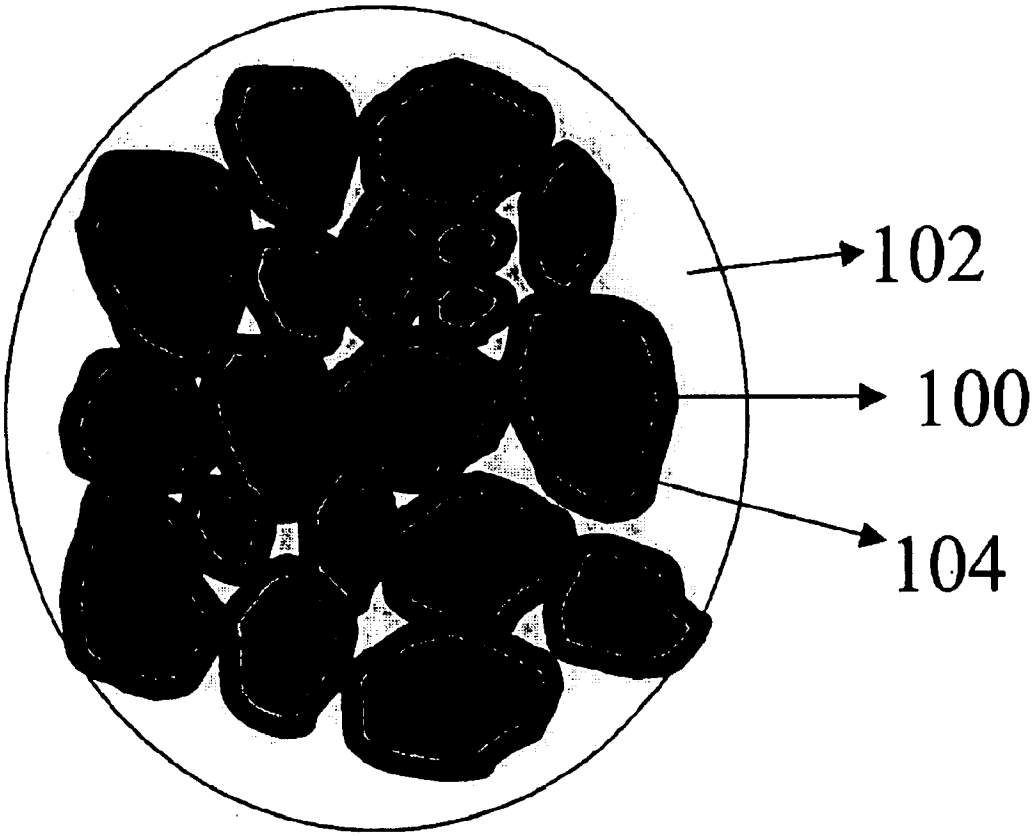
FIG. 1A is a cut-away view of one embodiment of the formulation.
Figure 1B:
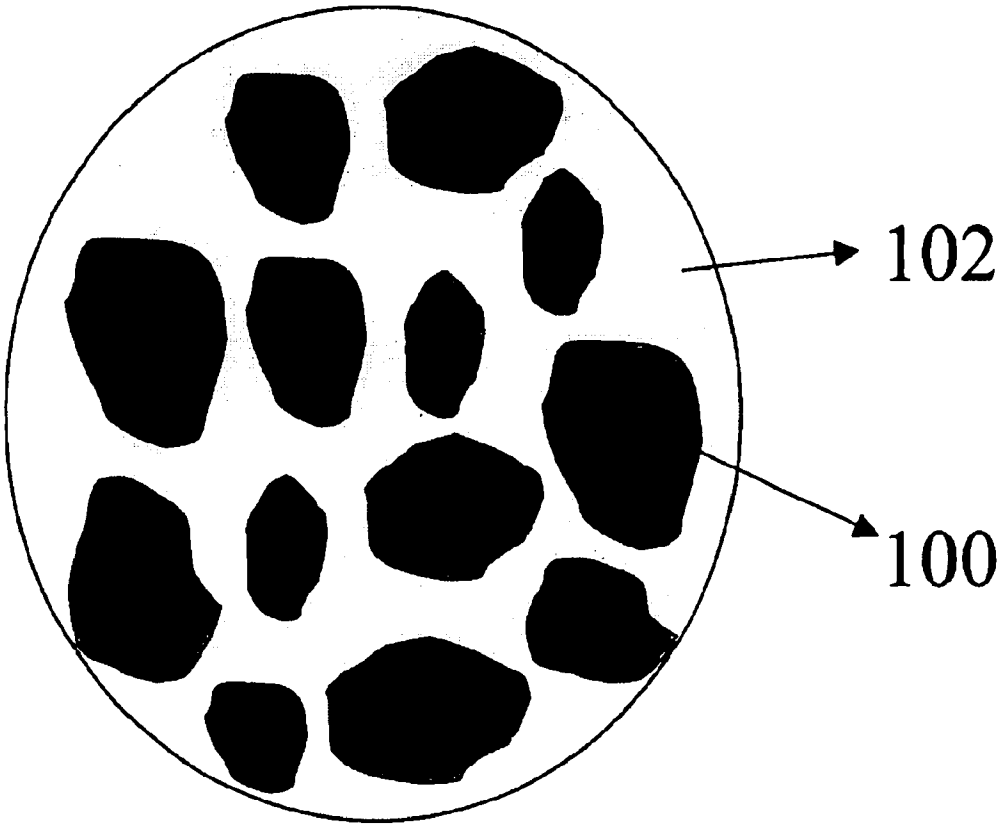
FIG. 1B is a cut-away view of another embodiment of the formulation.
Figure 1C:
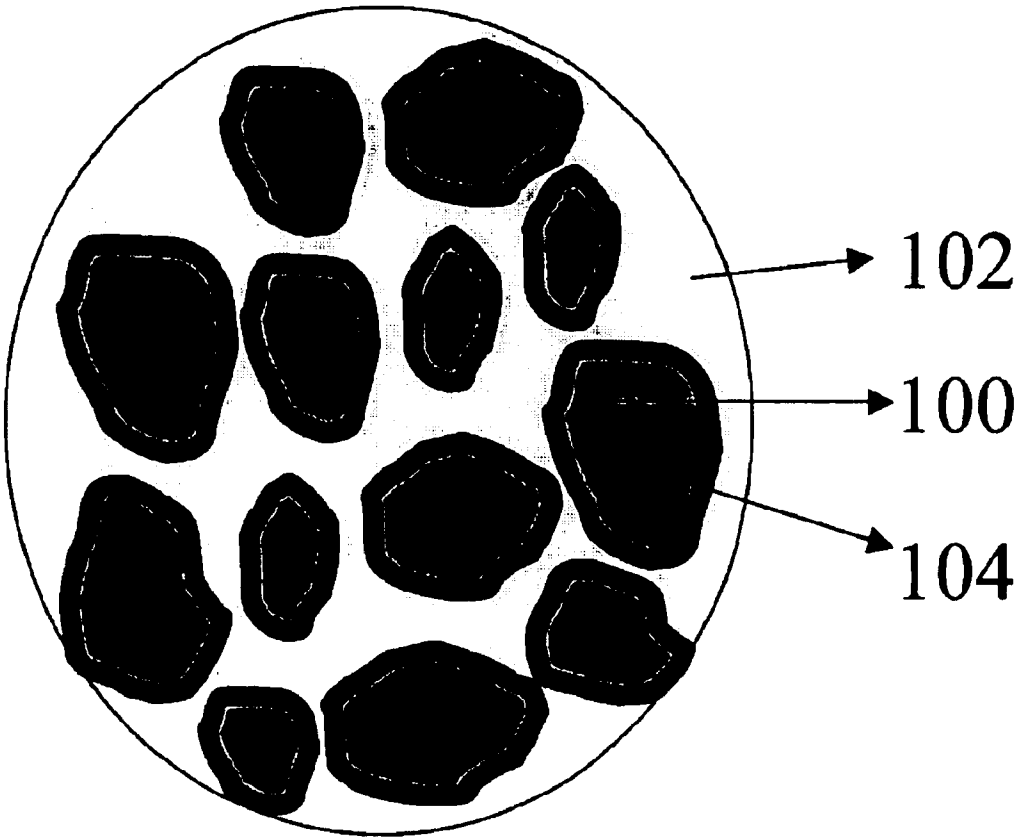
FIG. 1C is a cut-away view of a third embodiment of the formulation.
Figure 2:
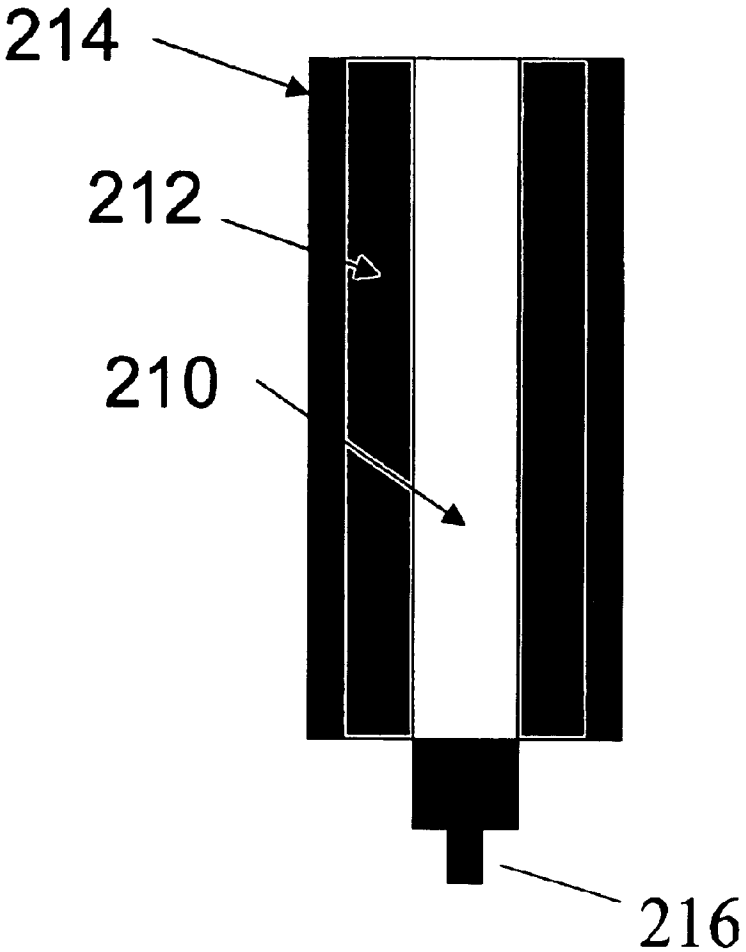
FIG. 2 is the embodiment depicted in FIG. 1 within a thermobaric warhead.
Figure 3:
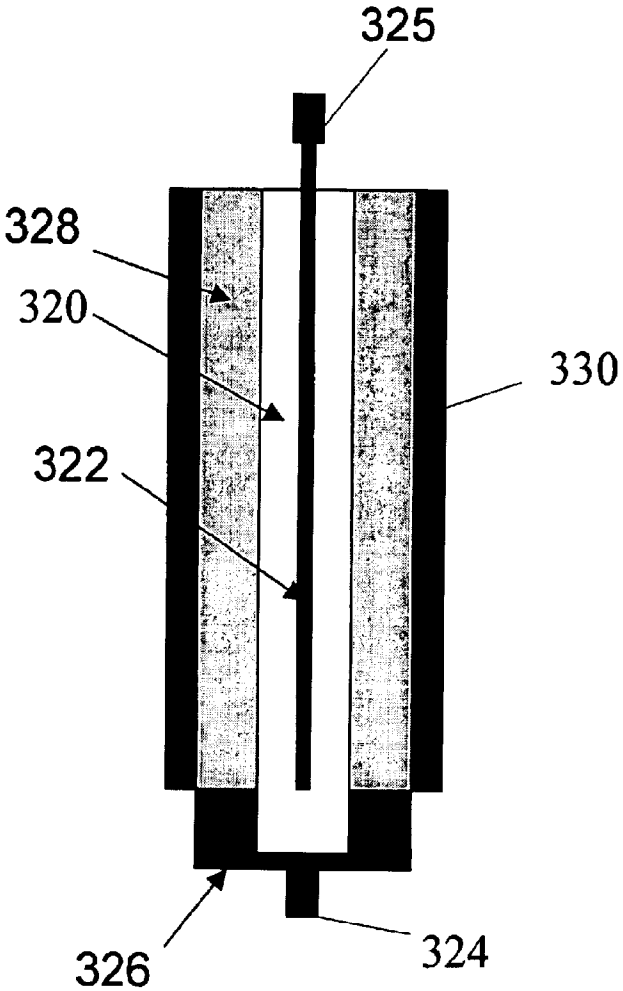
FIG. 3 is the embodiment depicted in FIG. 1 within a variable output warhead.

Referring to FIGS. 1A–1C, the invention comprises a plurality of energetic, macroscopic fragments 100 that are held together by a base material 102. The space between the fragments 100 is uniformly filled with the base material 102. In certain embodiments of the invention, such as illustrated in FIG. 1B and FIG. 1C, a coating 104 may be applied to the fragments 100. The coating 104 may be shock sensitive and heat insensitive or heat sensitive and shock insensitive, depending on the application. For example, referring to FIG. 1C, illustrating an explosive made by pressing, there is very little space between the fragments 100 for the binding material 102, so the fragments are coated with a relatively-thick layer of a shock-sensitive energetic material 104.

The fragments 100, are macroscopic in nature, rather than particles. This means that the fragments 100 comprise complete composite explosive ingredients, which may include energetic materials, a fuel, an oxidizer, and a binder. While the size of the fragments 100 may be selected by one skilled in the art to meet different requirements, typical fragments 100 will be about 2 mm in diameter in size or larger. The fragments 100 will be shock insensitive, meaning that a weak shock will not initiate the fragments 100. The fragments 100 may be heat sensitive or heat insensitive depending upon the output of the composition as desired and discussed further below. While many energetic materials may be used for the fragments 100, certain explosive materials are preferred for particular embodiments of the invention. One preferred material is PBXN-100, which is made up of HMX and HTPB binder. Other examples of explosive materials that can be used for the fragments 100 include ammonium perchlorate, aluminum particles, and a polymeric binder matrix; RDX (cyclotrimethylene trinitramine), aluminum particles, and a binder; or nitrocellulose, hafnium, and a binder. In certain embodiments of the invention, it is desired that the fragments 100 are made of a propellant which produces an acid when it burns. For example, a propellant containing ammonium perchlorate produces HCl when it burns. Another example would be fine copper powder seeded with a small fraction of RDX and pressed in a binder. A final example would be a porous material impregnated with liquid halogens and sealed in an encapsulating passive layer. Finally, in another embodiment of the invention, the fragments 100 comprise a reactive material, such as a mixture of aluminum and teflon® (polytetraflouroethylene).

The fragments 100 may be manufactured using many known processing techniques. For example, PBXN-110 may be normally cast, and then fragmented to the desired size using a process that will not significantly sensitize the fragments 100 (causing them to become shock sensitive). One method would be to extrude the PBXN-110 into rods and chop the rods into the desired lengths. This is a process similar to that used to manufacture gun propellants. The fragments 100 would then be cured to complete their processing.

The base material 102 will normally be either an explosive material that is shock sensitive or a substantially inert material, such as a binder, one preferred binder being wax. The selection is dependent upon the desired output of the composition as further discussed below. If an inert material is used, normally the amount of base material 102 will be less than if an explosive material is selected. The configuration of the composition when an inert material is selected for the base material 102, as illustrated in FIG. 1C, would normally be the case when the fragments 100 are pressed and the base material 102 comprises less than 10 percent by weight of the composition, more preferably about 3 percent to about 5 percent, merely being present to hold the pressed fragments 100 into position. In this embodiment, very little space exists between the fragments 100. The fragments 100 are then coated with a relatively thick layer of a relatively shock sensitive material 104, one preferred example being PBXN-301, composed of PETN and rubber.

If an explosive material is selected for the base material 102, normally from about 20 to about 30 percent by weight of base material 102 will be present, as illustrated in FIG. 1A and FIG. 1B. The explosive is normally shock sensitive and one preferred example is Pentolite, composed of PETN and TNT, and manufactured by melt casting techniques.

If the detonation products of Pentolite are not hot enough to reliably start the surface of the PBXN-110 fragments burning, a coating 104 of PBXN-301, which contains a substantially higher fraction of PETN than Pentolite, is added, as illustrated in FIG. 1B. Again, melt casting is a suitable technique for manufacturing the explosive charge.

In general, currently known manufacturing techniques may be used to incorporate the fragments 100 into the base material 102. For example, instead of pressing, after the curing of the fragments 100 is complete, they are dispersed into a mixture of PETN and a binder, then, the curative for the binder may be added. This will result in the fragments 100 being dispersed throughout the base material 102.

The coating 104 may provide two separate functions, and, depending upon the function required, may also be selected by one skilled in the art. First, the coating 104 may be shock sensitive and heat insensitive in order to promote burning along the surface of the fragments 100. This type of coating 104 will ignite when subjected to a weak shock, which, in turn, makes the shock insensitive, but heat sensitive fragment 100 burn, but not initiate. An example is PBXN-301. Second, the coating 104, may be shock insensitive, but heat sensitive to begin the burning process around the fragments 100. This type of coating 104 will not ignite when subjected a weak shock (similar to the fragment 100), but will begin the burning process around the fragment 100.

There are three basic embodiments of the above described formulation that may be employed in numerous configurations. The first embodiment, illustrated in FIG. 1A, includes a base material 102 comprising an explosive material that is more shock sensitive than the fragments 100. In this embodiment, the fragments 100 are shock insensitive, but heat sensitive so that a weak shock detonates the base material 102 with the resulting hot gases from said detonation starting the surface of the heat sensitive fragments 100 to burn.

In the second embodiment, illustrated in FIG. 1B, the base material 102 also includes an explosive material that is more shock sensitive than the fragments 100. However, the fragments are not heat sensitive enough for their surface to be reliably ignited by the hot detonation products of the base material. Therefore, a heat sensitive, but shock insensitive explosive material is used to coat 104 the fragments 100 to ensure ignition.

The final embodiment, illustrated in FIG. 1C, comprises shock-insensitive fragments 100 that are heat sensitive, coated 104 with an explosive material that is shock sensitive. The base material 102 filling the interstitial spaces comprises an inert material that simply holds the fragments together. Therefore, in this configuration, the base material 102 would comprise a substantially smaller fraction of the overall mass/volume of the formulation than in the embodiments described above. When a weak shock is applied to this embodiment, the coating explosive 104 is ignited and the resulting hot gases start the surface of the heat sensitive fragments 100 burning.

Thus, in all of the embodiments described above, a weak shock results in the energetic fragments 100 being dispersed then ignited, but not detonated. However, as a strong shock sweeps through the explosive charge, it would result in ignition of the bulk of the fragments 100, thus initiating a detonation wave if the individual fragment's 100 composition is commensurate with an explosive's. Therefore, the formulation's output can be varied depending upon the stimulus provided.

The invention also includes various warheads employing the composition disclosed herein. In one embodiment, a thermobaric warhead can be designed using the invention. A typical thermobaric warhead is the Russian design including a surround charge composed of aluminum and RDX particles in gelled IPN (ISOPROPYL NITRATE). During operation, the IPN is dispersed into air that is heated by the blast wave. The extra heat released by the decomposition of the IPN helps ignite the aluminum particles mixed with the compressed hot air behind the shock leading the blast wave. This type of thermobaric warheads employ a gelled-liquid material in its backbone (IPN). For safety purposes, U.S. military requirements do not allow liquid materials within warheads. The present invention may be employed in a warhead to provide the same output as the thermobaric warhead described above. Referring to FIGS. 1A–1C and 2, the warhead comprises a central explosive booster material 210, that is a weak booster (provides a weak shock), surrounded by an embodiment of the composition 212 discussed above. A metal case 214 surrounds the composition 212 and initiation means 216 are placed at an end of the warhead. In operation, the macroscopic fragments 100 are a shock insensitive explosive and are dispersed out of the fireball into the compressed air behind the shock provided by the base material 102 explosive. As these burn, the extra energy released reinforces the shock, which therefore does not decay as fast as in traditional blast waves. To increase their energy by making use of the oxygen (air) between the fireball and shock, the fragments 100 preferably contain fuel particles, such as aluminum. Small fuel particles are preferred because they burn faster. Many particles should be consolidated within each fragment 100. After the macroscopic fragments 100 are scattered, these microscopic fuel particles in turn have to be dispersed. Thus in addition, a gas-producing energetic material is used in each fragment 100. For example, a fragment 100 may contain ammonium perchlorate and aluminum particles in a polymeric binder matrix, or RDX, aluminum, and binder, or nitrocellulose, hafnium, and binder, etc. Basically, each fragment 100 is a complete explosive (or propellant) formulation, but that is (surface) burned instead of detonated. The charge is manufactured by consolidating macroscopic explosive/propellant fragments 100 instead of microscopic particles.

The configuration in FIGS. 1A–1C and 2 can also be used for a warhead that is designed to damage electronic equipment by chemically attacking the components or short circuiting them instead of using the blast or heat to mechanically/thermally damage them. In this case, the fragments 100 can be made of a propellant that produces acids when it burns, such as HCl from ammonium perchlorate. The fragments 100 can also be made of pressed (in a binder) fine copper powder seeded with a small fraction of RDX. When these burn, the copper particles are deposited on the surface of any unprotected circuit, thus shorting it. Finally, the fragments 100 can be made of a porous material impregnated with liquid halogens and sealed in an encapsulating passive layer.

A second warhead embodiment comprises a variable output warhead. Referring to FIGS. 1A–1C and 3, the warhead comprises a central material 320, preferably comprising aluminum and a binder. Within the central material 320 a detonation cord 322 is placed. Two initiation points 324, 325 are placed at opposite ends of the detonation cord 322. A booster material 326 is placed proximate to the end of the warhead near initiation point 324. An embodiment of the present composition 328 is placed around the central material 320 and a metal case 330 surrounds the composition 328. If the fragments 100 comprise a shock insensitive explosive material such as PBXN-100 as described above, the following warhead applications may be obtained. If initiation point 324 is fired, the booster material 326 initiates a detonation in the composition 328, and we get high fragments 100 velocity. If initiation point 325 is fired, instead, the weak shock generated by the detonation cord 322 will not be enough to initiate a detonation wave in the composition 328, but it will fracture it and ignite it, i.e., start the resulting fragments 100 burning. It will also fracture the metal case 330, thus allowing the products and the explosive fragments 100 to escape, but the velocity of the resulting metal fragments, from the metal case 330, will be minimal. If both initiators 324, 325 are fired, but sequentially, initiator 325 first, then 324, the fragment 100 velocity will depend on the time delay before initiator 324 is fired—the longer the delay, the smaller the velocity.

Figure 4:
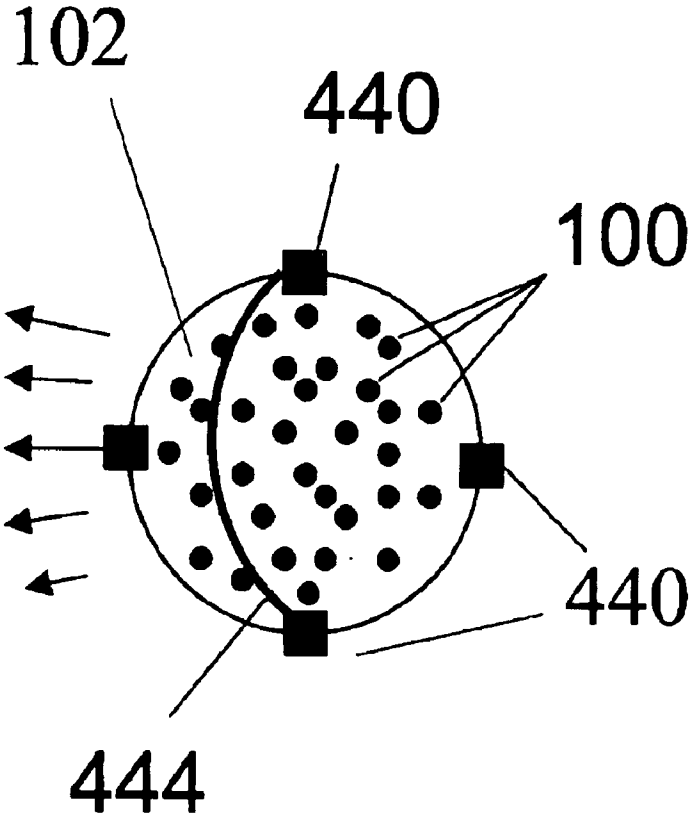
FIG. 4 an embodiment of the formulation including multiple initiation points to create a warhead to produce directional, reactive fragments as an output.

One final warhead embodiment, depicted in FIGS. 1A–1C and 4, comprises multiple initiation points 440 around the composition 442 that is cylindrical. Instead of making a casing of a sintered aluminum and polytetraflouroethylene mix, that is standard for warheads capable of launching reactive fragemnts, fragments 100 of the same material (aluminum+polytetraflouroethylene) can be loaded directly into the base material 102 explosive, thus, avoiding spalling the fragments 100 as well as controlling their direction. While the fragments of a traditional warhead shell are usually launched in a direction orthogonal to the surface of the shell, solid fragments 100 imbedded in an explosive (base material 102) are launched in a direction orthogonal to the detonation wave 444. Thus, if as illustrated in FIG. 4, several initiations points 440 are included in the warhead, the fragments 100 can be launched in a relatively narrow solid angle substantiating a single direction.

What is described are specific examples of many possible variations on the same invention and are not intended in a limiting sense. The claimed invention can be practiced using other variations not specifically described above.

What is claimed is:

1. A composition, comprising:

a plurality of shock insensitive, energetic fragments, each fragment a complete energetic formulation comprising at least two different components selected from the group of explosive particles, fuel, oxidizer, and binder; and, a base material to hold the plurality of fragments together wherein a weak shock results in ignition of a surface of the fragments and a strong shock results in initiation of the fragments.

2. The composition of claim 1, further comprising a shock sensitive coating substantially covering the fragments.

3. The composition of claim 2, wherein the base material comprises a substantially inert material.

4. The composition of claim 3, wherein the base material comprises about less than 10 percent by weight of the composition.

5. The composition of claim 4, wherein the base material comprises from about 3 percent by weight to about 5 percent by weight of the composition.

6. The composition of claim 5, wherein the base material comprises a binder.

7. The composition of claim 6, wherein the fragments comprise an explosive formulation.

8. The composition of claim 7, wherein the fragments comprise PBXN-110.

9. The composition of claim 8, wherein the shock sensitive coating is selected from PBXN-301 or a PETN powder.

10. A warhead, comprising:

a plurality of shock insensitive, energetic fragments, each fragment a complete energetic formulation comprising at least two different components selected from the group of explosive particles, fuel, oxidizer, and binder;

a base material to hold the plurality of fragments together wherein a weak shock results in ignition of a surface of the fragments and a strong shock results in initiation of the fragments;

an explosive booster material, proximate to initiation means, to provide a weak shock; and, a metal case, surrounding the base material.

* * * * *